United States Patent [19]

Beverly

[11] Patent Number: 4,522,139

[45] Date of Patent: Jun. 11, 1985

[54] TUFTING MACHINE BROKEN YARN DETECTOR

[75] Inventor: Ian Beverly, Blackburn, England

[73] Assignee: Spencer Wright Industries, Inc., Chattanooga, Tenn.

[21] Appl. No.: 516,971

[22] Filed: Jul. 25, 1983

[51] Int. Cl.[3] ..... B65N 63/00; B65N 69/36; D05B 51/00

[52] U.S. Cl. ..... 112/273; 112/278

[58] Field of Search ..... 112/273, 278; 66/163; 250/561, 562, 572; 139/353, 372.2; 28/187

[56] References Cited

U.S. PATENT DOCUMENTS

| | | | |
|---|---|---|---|
| 3,429,146 | 2/1969 | Cvach | 66/163 |
| 3,530,690 | 9/1970 | Nickell et al. | 66/163 |
| 3,752,997 | 8/1973 | MacKenzie et al. | 28/187 X |
| 4,100,425 | 7/1978 | Ohsawa | 250/561 |
| 4,364,247 | 12/1982 | Muns-Magem et al. | 66/163 |
| 4,444,132 | 4/1984 | Breitbach | 66/163 |

*Primary Examiner*—Ronald Feldbaum
*Attorney, Agent, or Firm*—Alan Ruderman

[57] ABSTRACT

A tufting machine has a broken yarn detector mounted intermediate the yarn feed mechanism and the needles, the detector having a multiplicity of yarn engaging fingers pivotably mounted in a support housing secured to a frame carried by the tufting machine. Each finger has an eyelet for receiving a strand of yarn which during normal operation of the tufting machine supports the finger in a raised position, but which drops when the yarn is broken. A signal generator and a signal receiver in the form of a light source and a photo-conductive receiver respectively are carried by the frame of the broken yarn detector at a disposition such that when a finger drops it interrupts the transmission of the light beam from the transmitter to the receiver to provide a signal which may be used to stop the tufting machine. The housing of the broken yarn detector supports a lifting member which may be raised to lock all the fingers in a raised position for threading of yarn therethrough and may be lowered during normal operation of the tufting machine and yarn detector. The frame also carries a support member for supporting selective non-threaded fingers in a remote position when such fingers are not being utilized.

11 Claims, 4 Drawing Figures

TUFTING MACHINE BROKEN YARN DETECTOR

BACKGROUND OF THE INVENTION

This invention relates to tufting machines and more particularly to the detection of broken yarn ends adjacent the needles.

In a tufting machine more than 1,000 needles each carrying an individual yarn is employed for penetrating a backing material to insert loops of yarn therein, the loops being seized by a looper. Because of defects in the yarn itself or because of excessive tension or friction or other conditions, yarn breaks frequently occur before the yarn is stitched into the backing. When this occurs the product is defective and must be repaired as soon as the defect is detected. In high speed machines, however, in some instances the defect goes undetected or is difficult to repair, especially when the gauge is fine. Thus, the machine must be stopped to repair the defect if detected or the product must be discarded if it has gone undetected and is subsequently processed.

It is known in the prior art to detect broken yarn ends and to stop the machine upon occurrence of a break. For example, Jackson U.S. Pat. No. 3,529,560 and Merkle U.S. Pat. No. 3,764,773 disclose electromechanical devices having yarn supporting feelers or drop wires which drop when the yarn breaks to stop the machine. Other patents disclose electromechanical devices to shut the machine upon the detection of a high tension in the running yarn. These known electromechanical devices not only involve a large number of moving parts but are difficult to adjust and maintain. Moreover, because of their constructions, the known prior art devices have been mounted high up on the head of the tufting machine.

Ideally the broken yarn end detector should be placed between the feed means and the loop seizing location, and at least as close to the needles as possible so that a broken yarn can be detected at or adjacent the formation of the stitch such that a minimum amount of wasted fabric would be produced. This is particularly true in high speed tufting machines where subsequent mending is difficult. However, the aforesaid yarn supporting drop wires of the prior art were placed high up on the head of the tufting machine so as not to hinder a worker in threading yarn through the needles of the machine and making necessary adjustments including the replacement of broken needles. This is especially true when the yarn is not yet threaded through most of the drop wires and the wires are in the dropped position.

Thus, light beam devices were developed which could be placed closer to the needle location. In Jackson U.S. Pat. No. 3,687,095 one or two light beams are transmitted longitudinally across a tufting machine to photo-conductive receivers. When a yarn is broken, either a broken yarn end will fall into the light beam or a loop of yarn will be formed to enter the light beam and break the beam to interrupt current flow through a triggering circuit to deenergize the machine motor and shut the machine. Thus, proper operation of the device requires the broken yarn end or loop of yarn to enter the light beam. However, due to machine vibration and other operating conditions it is difficult to ensure that the yarn will enter the light beam when a break occurs, and this apparatus has not proved to be successful.

SUMMARY OF THE INVENTION

Consequently, it is a primary object of the present invention to provide apparatus for reliably detecting broken yarn ends in a tufting machine which can be mounted near the needles and yet not hinder the needle threading operation.

It is another object of the present invention to provide apparatus for reliably detecting broken yarn ends in a tufting machine having a plurality of thin planar fingers including a yarn receiving eyelet, the yarn supporting the fingers in a raised position during normal operation of the tufting machine and the fingers dropping to provide a signal when a yarn is broken.

It is a further object of the present invention to provide apparatus for reliably detecting broken yarn ends in a tufting machine having a plurality of thin planar fingers including a yarn receiving eyelet, the yarn supporting the fingers in a raised position during normal operation of the tufting machine and the fingers dropping to provide a signal when a yarn is broken, and means for holding at least selective fingers in a raised position so as to not interfere with threading of the needles.

Accordingly, the present invention provides apparatus for a tufting machine having a multiplicity of yarn engaging fingers pivotably mounted in a support housing on a frame intermediate the yarn feed means and the needles, each finger having an eyelet for receiving a strand of yarn which during normal operation of the machine supports the finger in a raised position, but which when the yarn strand is broken drops to provide a signal. Preferably the signal providing means comprises a light beam transmitted between elements supported on the frame. The housing includes a lifting member that may be lowered during normal operation of the tufting machine and may be raised and secured to hold all the fingers in a raised position so that yarn may be threaded readily through the finger eyelets, the yarn guides and the needles. The fingers are thin substantially planar members so that a multiplicity thereof may be carried by the housing in closely spaced relationship for very fine gauge tufting machines. Moreover, the frame carries yarn guide means for directing the yarn to the fingers and support members for supporting selective non-threaded fingers such as when a narrow width or courser gauge product is tufted.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
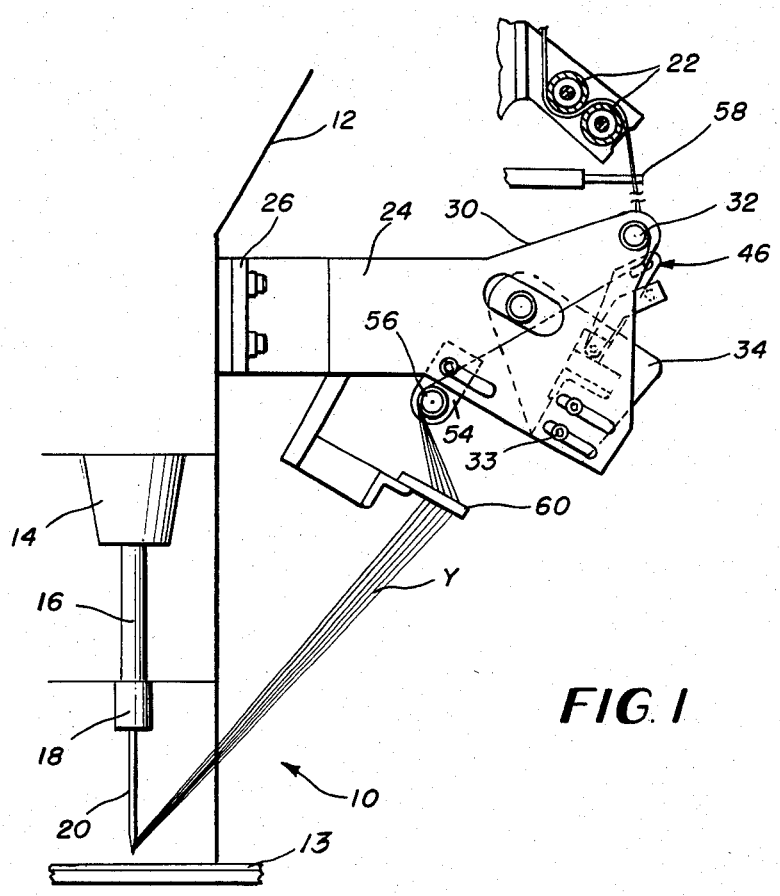
FIG. 1 is an end elevational view of a tufting machine incorporating apparatus of the present invention with portions of the machine broken away for clarity of presentation and with the fingers locked in the threading position.
Figure 2:
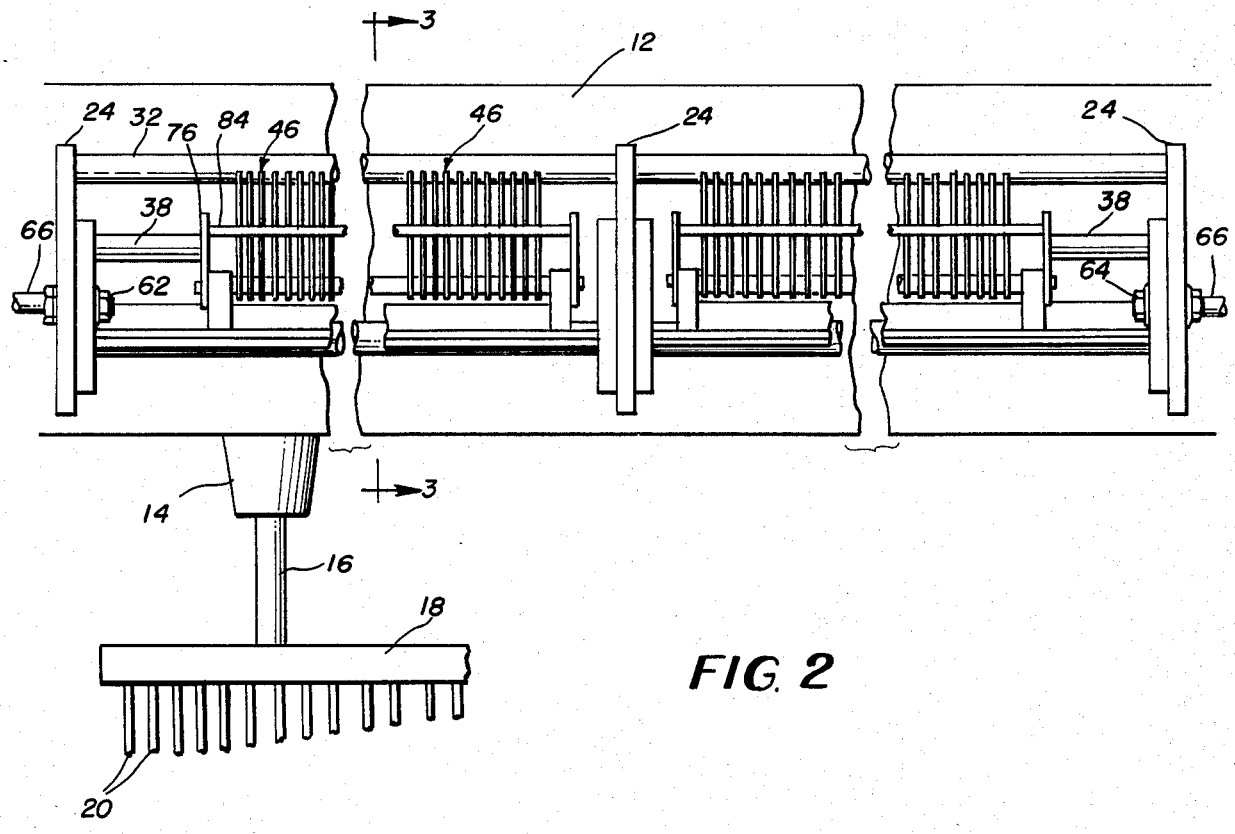
FIG. 2 is a front elevational view of the apparatus of FIG. 1.

Referring to the drawings, and particularly FIGS. 1 and 2 a portion of a tufting machine 10 is illustrated having a head 12 on which a plurality of bushings 14 are mounted. Each bushing 14 journally supports a push rod 16 for vertical reciprocation in the head. The lower end of each push rod supports a needle bar 18 which carries a multiplicity of needles 20 for penetrating a base material 13 supported beneath the head. Each needle 20 is threaded with a yarn end Y fed from a yarn feed means such as rolls 22, and as well known in the art forms a loop which is seized by looper means (not illustrated) beneath the base material.

In a typical tufting machine there are approximately 1,000 needles while in very fine gauge machines, especially those that produce upholstery fabric, the number of needles may approximate 2,000. Thus, it is difficult, if not impossible, to visually determine when a yarn end breaks so that the corresponding needle is not stitching. In high speed machinery a large amount of defective fabric results when such a break occurs, and when the gauge is extremely small, large defects are difficult to repair, resulting in substantial amounts of scrap fabric. Obviously, the quicker the yarn break can be detected, the smaller the amount of defective fabric produced and the easier the defect can be repaired.

The present invention provides a broken yarn detector that can be readily mounted intermediate the yarn feed means 22 and the needles 20 which rapidly detects a broken yarn end and provides a signal which may be used to automatically stop the operation of the tufting machine. To this end a broken yarn end detector constructed in accordance with the principles of the present invention includes a frame comprising a pair of spaced brackets 24 mounted at intervals across the side of the tufting machine from where the yarn enters. Each bracket 24 has a base portion 26 secured to a foot 28 which in turn is fastened to the head 12 of the tufting machine at a disposition above the bushings 14, and an enlarged generally triangular portion 30 extending from the base portion remote from the foot 28. The portion 30 includes a bore within which a rod 32 is received and extends to span each pair of spaced brackets 24 and functions as a yarn guide. Adjustably secured by bolt means 33 to each bracket 24 on the surface facing cooperative spaced brackets, is another bracket 34. An angle beam or the like 36 is secured to and spans each spaced pair of brackets 34 as does a rod 38, the rod 38 being spaced from the beam 36 toward the tufting machine instrumentalities.

Fastened to the beam 36 are a plurality of substantially L-shaped finger support block members 40. These members, have a base portion 42 secured to the beam 36 in end-to-end fashion and have the upstanding portion 44, which may be a separate member, slotted for receiving a finger 46 in each slot 48. There are a multiplicity of fingers 46, preferably one for each yarn end, i.e., one finger corresponding to each needle, and each finger is pivotably mounted on and pivotable about a shaft 50 extending through the respective slots 48. Each of the fingers 46 is a thin substantially flat planar member preferably stamped from sheet material having diverging tapered edges extending from the pivotably mounted end toward an outer end. One of the edges, that being the edge facing the tufting machine, sharply tapers back toward the other edge where the edges join together at a smooth arcuate outer edge at the end remote from the shaft 50. Formed in each finger adjacent the outer edge in the area where the edge facing the tufting machine tapers toward the outer edge is a yarn receiving eyelet 52 preferably of an oblong configuration having its major axis skewed relative to the edges of the fingers.

Figure 3:
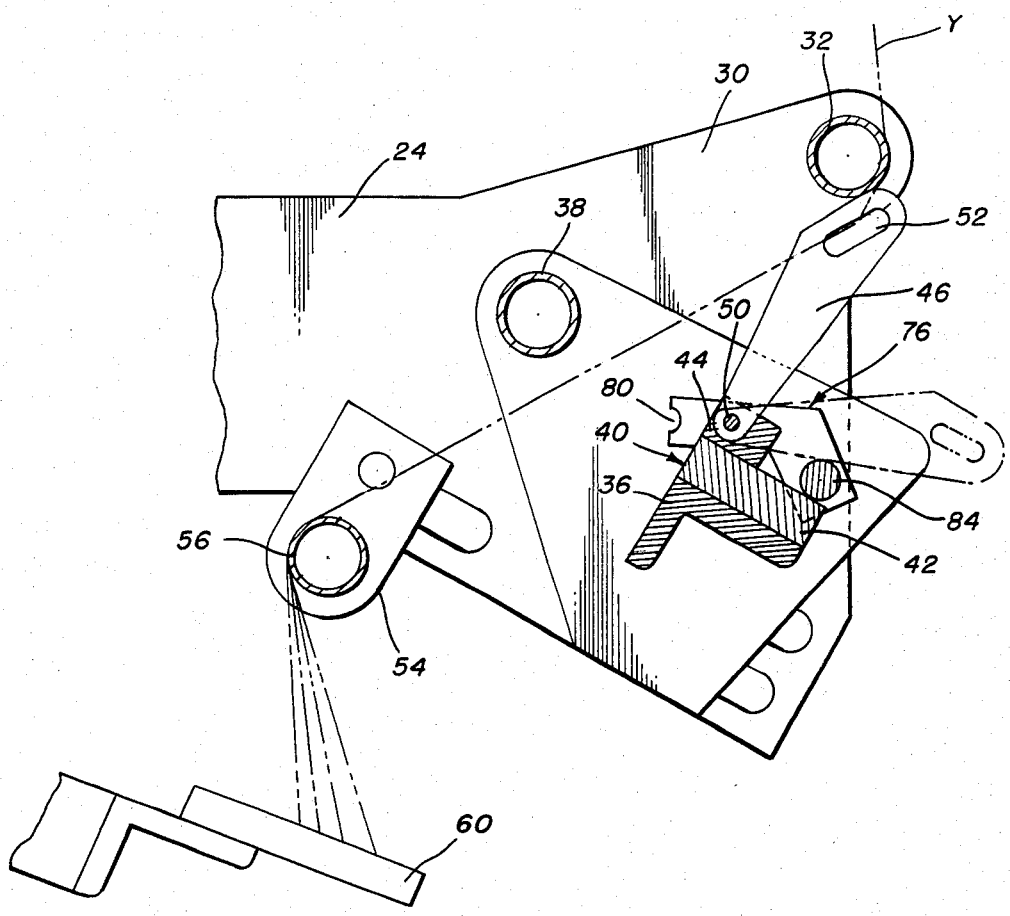
FIG. 3 is an enlarged cross sectional view of the apparatus taken substantially along line 3—3 of FIG. 2, with the fingers unlocked and in the operating position.
Figure 4:
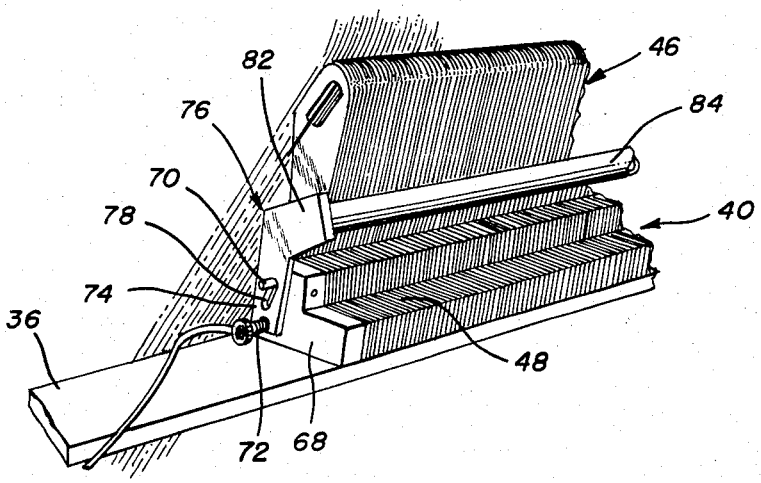
FIG. 4 is a perspective view of a portion of the apparatus with the fingers locked in the threaded position.

A small bracket 54 may be adjustably secured to and extend downwardly from the brackets 24 for supporting a rod 56 spanning to such brackets. A yarn strand or end from the yarn feed means 22 is guided by a yarn guide 58 on the tufting machine, and then about the lower surface of the guide rod 32, through the eyelet 52 and thence about the upper surface of the guide rod 56 from whence it extends to another tufting machine yarn guide 60 to the needles 20. When so threaded, and after the yarn is locked into the backing material by the stitching action, the yarn tension is such that the yarn acts against the upper edge of the eyelet 52 and holds the respective finger in a raised position. However, if a yarn end breaks between the needles and the feed means the finger supported thereby pivotably drops to the position illustrated in phantom in FIG. 3.

Disposed in one of the brackets 34 is a light transmitting element 62 which sends an axial beam toward a photo-conductive light sensing element 64 in the other of the brackets 34 at a similar disposition so that the light transmitted by the member 62 is normally received by the element 64. The transmitting element 62 and the receiving element 64 are disposed relative to the fingers such that they are below the normal position of the fingers and at a location such that when a yarn end breaks the finger drops into the beam. This interrupts the receipt of the beam from the transmitter 62 to the sensor 64. The transmitter 62 and sensor 64 are connected through wiring 66 with circuit elements (not illustrated) in conventional manner to provide a signal when the light beam is interrupted, and preferably the circuit includes means for shutting power flow to the tufting machine motor to stop the machine so as to limit the amount of defective fabric produced. Since such circuitry is well known, as illustrated in the aforesaid Jackson U.S. Pat. No. 3,687,095, and does not itself form part of the present invention, further disclosure is not deemed necessary.

Mounted on each end of the block members 40 is a further substantially L-shaped member 68 having a peg 70 extending out the side of the upstanding portion adjacent the top thereof and directed away from the slots 48. Another peg which may be in the form of a screw 72 extends from the member 68 substantially parallel to the peg 70. Formed in a leg 74 of a lever member 76 is an elongated slot 78 and spaced below the slot 78 is another but open end slot 80. The peg 70 is received through the slot 78 and when the leg is disposed upwardly with the peg 70 at or adjacent the border of the slot 78 remote from the slot 80, the peg 72 is received within the slot 80. Lifting the leg 74 releases the peg 72 from the slot 80 and permits the lever 76 to pivot and slide about the peg 70. The lever 76 also includes another leg 82 at an angular disposition relative to the leg 74. A rod 84 extends between and spans the lever members 76 and connects them together. When the lever members 76 of a unit are disposed in the upstanding position with the peg 72 within the slot 80, the rod 84 abuts the normally lower surface of the fingers and locks the fingers in a raised position. Without such a finger holding or locking device a workman must hold the finger in an upward position manually while threading the yarn through the yarn guides, the finger eyelets and through the needles. Thus, were it not for this construction, an additional workman would be required to hold the fingers in a raised position while one workman is threading the yarn.

Also mounted between the bracket members 34 is another rod 86 which is disposed intermediate the tufting machine and the normal operating position of the fingers 46 and at a disposition to engage the tapered surface of the finger when a finger is manually moved toward the tufting machine. Since the fingers are extremely thin each finger may be flexed slightly to the side to clear the guide rod 32 and pivoted rearwardly to abut the rod 86. This is useful when narrower width of fabric is to be produced on a tufting machine having fingers which extend the full width of the machine, and when a courser gauge fabric is being tufted than the gauge of the fingers so that certain of the fingers may be rendered inoperative and in non-interferring relationship with the yarn.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. In a tufting machine having a multiplicity of yarn carrying needles mounted laterally across said machine and reciprocatably driven to penetrate a base material to insert loops of yarn therein, yarn feed means for feeding a yarn strand to each needle, apparatus intermediate said needles and said feed means for detecting a broken yarn, said apparatus comprising a frame supported on the tufting machine including a housing, a multiplicity of finger members, means for pivotably mounting said finger members in side-by-side relationship in said housing laterally across said machine, each of said fingers comprising a substantially flat member having planar laterally facing surfaces, means defining an eyelet extending through said surfaces for receiving a yarn strand such that each yarn strand may pass through a respective eyelet intermediate said feed means and a corresponding needle, said housing and fingers being disposed such that each finger is pivotably held in a raised position by a corresponding yarn strand and is pivotably dropped when the strand is broken, signal transmitting means mounted on said frame at a location beyond a first lateral extreme of said fingers beneath the raised position of said fingers for generating a signal, cooperating signal receiving means mounted on said frame at a location beyond the other lateral extreme of said fingers beneath the raised position of said fingers for receiving said signal when said fingers are in the raised position, said signal transmitting and receiving means being disposed such that the signal is interrupted by a finger when the corresponding yarn strand is broken and said finger drops, and locking means for holding substantially all of said fingers in a locked raised position for threading.

2. In a tufting machine as recited in claim 1, wherein said signal comprises a light beam.

3. In a tufting machine as recited in claim 1, wherein said locking means comprises a lever member mounted on the housing at each lateral extremity, said housing and said lever having cooperating means for holding said levers in a first position corresponding to said locked position of said fingers and a second position remote from said raised locked position, and rod means fastened to said levers for holding said fingers in the locked position when said levers are in the first position.

4. In a tufting machine as recited in claim 3, wherein each of said levers includes an open end slot formed in a first extremity thereof and an elongated slot formed intermediate said open end slot and a second extremity thereof, said housing having a pair of spaced pegs at each extremity, one of the pegs of each pair being disposed within said elongated slot and the other of the pegs being disposed for receipt within said open end slot selectively, and said rod means is fastened adjacent said second extremity.

5. In a tufting machine as recited in claim 4, wherein said level comprises a first leg and a second leg disposed angularly relatively thereto, said slots being formed in said first leg and said rod being fastened to said second leg.

6. In a tufting machine as recited in claim 1, wherein said means for mounting said fingers in said housing comprises a multiplicity of parallel slots spaced laterally in said housing, there being one slot for receiving each finger, and shaft means extending through said slots for journally carrying said fingers.

7. In a tufting machine as recited in claim 1, including a rod disposed remote from said shaft relative to said signal transmitting means and spaced from said shaft a distance less than the length of each finger such that each of said fingers may be pivoted to abut and rest on said rod selectively.

8. In a tufting machine as recited in claim 7, wherein said signal comprises a light beam.

9. In a tufting machine as recited in claim 7, wherein said locking means comprises a lever member mounted on the housing at each lateral extremity, said housing and said lever having cooperating means for holding said levers in a first position corresponding to said locked position of said fingers and a second position remote from said raised locked position, and rod means fastened to said levers for holding said fingers in the locked position when said levers are in the first position.

10. In a tufting machine as recited in claim 9, wherein each of said levers include an open end slot formed in a first extremity thereof and an elongated slot formed intermediate said open end slot and a second extremity thereof, said housing having a pair of spaced pegs at each extremity, one of the pegs of each pair being disposed within said elongated slot and the other of the pegs being disposed for receipt within said open end slot selectively, and said rod means is fastened adjacent said second extremity.

11. In a tufting machine as recited in claim 10, wherein said lever comprises a first leg and a second leg disposed angularly relative thereto, said slots being formed in said first leg and said rod being fastened to said second leg.

* * * * *